United States Patent [19]

Zannoni

[11] Patent Number: 4,641,486

[45] Date of Patent: Feb. 10, 1987

[54] METHOD AND AN ARRANGEMENT FOR PACKING MACHINES

[75] Inventor: Eros Zannoni, Rubiera, Italy

[73] Assignee: Tetra-Dev Co., Modena, Italy

[21] Appl. No.: 758,886

[22] Filed: Jul. 25, 1985

[30] Foreign Application Priority Data

Jul. 31, 1984 [SE] Sweden ..... 8403925

[51] Int. Cl.[4] ..... B65B 31/00

[52] U.S. Cl. ..... 53/433; 53/451; 53/551; 53/511

[58] Field of Search ..... 53/51–79, 53/105, 403, 433, 451, 511, 551

[56] References Cited

U.S. PATENT DOCUMENTS

| | | | |
|---|---|---|---|
| 2,928,219 | 3/1960 | Gubler | 53/551 |
| 2,962,843 | 12/1960 | Hoelzer et al. | 53/449 X |
| 3,020,689 | 2/1962 | Luther | 53/551 X |
| 3,164,936 | 1/1965 | Loliger | 53/551 X |
| 3,470,672 | 10/1969 | Tuma | 53/551 X |
| 3,482,373 | 12/1969 | Morris | 53/511 |
| 3,589,913 | 6/1971 | Rosenberg | 53/451 X |
| 3,716,083 | 2/1973 | Tuma et al. . | |
| 4,081,944 | 4/1978 | Sjöstrand | 53/51 |

*Primary Examiner*—John Sipos
*Assistant Examiner*—Steven P. Weihrouch
*Attorney, Agent, or Firm*—Burns, Doane, Swecker & Mathis

[57] ABSTRACT

In a machine for manufacturing packing containers by sealing and cutting a tubular packing material, a sealing unit positioned in the tube comprising a sealing guide, a sealing holder movably supported by the sealing guide, a sealing member of flexible material on the periphery of the sealing holder which contacts the inside of the material tube and passages in the sealing guide and sealing holder for conveying pressurized air therethrough.

14 Claims, 2 Drawing Figures

METHOD AND AN ARRANGEMENT FOR PACKING MACHINES

FIELD OF INVENTION

The present invention relates to a method which converts a weblike packing material to packing containers through the conversion of the material web to a tube movable in a downwardly direction and through repeated transverse flattening and sealing together of the same, the lower part of the tube being sealed off from its upper open end by a sealing unit.

The invention also relates to an arrangement for the realization of the method on a packing machine of the type which converts tubular packing material to individual packing containers and comprises a sealing unit present in the tube which seals off a closed space in the lower end of the tube.

BACKGROUND OF THE INVENTION

Packing containers intended for example for milk or other liquid or semi-liquid foodstuffs are usually manufactured from laminated flexible packing material which comprises layers of paper, thermoplastics and aluminium foil. A known packing container is formed in that a web of the said packing laminate, while being fed through the packing machine, is successively converted to tubular shape in that its two longitudinal edges are joined together and sealed to one another in a liquid-tight manner. Subsequently, contents are delivered in the required quantity to the lower end of the packing material tube which, with the help of co-operating sealing jaws, is then divided into individual packing containers separated from one another through repeated transverse sealings of the packing material tube and subsequent cutting. At the same time a certain forming process is carried out so that the finished packing containers obtain the desired, e.g. parallelepipedic, shape.

In the conversion of the lower end of the packing material tube to individual packing containers of e.g. substantially square cross-sectional area use is made of the contents and the gas which is present in the packing material tube as a hold-on in the forming process, since otherwise the flexible packing material wrinkles together in an irregular manner. To prevent the contents and above all the enclosed gas from being pressed out through the upper open end of the packing material tube during the forming work, a sealing unit is positioned in the packing material tube a short distance above the area where the transverse flattening and forming work of the material tube is taking place. The sealing unit is supported from inside the tube by a filling pipe for the contents extending vertically through the tube. Because the packing material tube as well as the filling pipe are mutually movable, great demands are made upon the construction of the sealing unit if the desired tightness is to be obtained during operation of the machine, and solutions available at present using rubber sleeves, flexible "skirts" and the like have proven unsatisfactory, mainly because the required tightness could not be maintained during relative lateral movements between the filling pipe and the packing material tube. Moreover, because the pressure of the bell-shaped sealing sleeves against the inside of the material tube has to be relatively high an undesirable wear of the seal becomes noticeable.

OBJECTS OF THE INVENTION

It is an object of the present invention to provide a method which seals off in a satisfactory manner a required part of the lower end of the packing material tube so that it becomes possible during operation of the machine to maintain this lower tube end under the required pressure so as to allow the forming of the packing material tube.

It is a further object of the present invention to provide a method and apparatus for sealing off the lower end of a packing material tube, which are not subject to the disadvantages associated with methods and devices tried previously.

It is a further object of the present invention to provide a method for the sealing of a movable packing material tube, this method giving satisfactory tightness even in the presence of relatively large relative lateral movements between the packing material tube and the supporting element of the sealing.

These and other objects are achieved in accordance with the present invention which provides a sealing unit comprising a radially movable sealing holder with a peripheral sealing which rests against the inside of the material tube, the gaseous pressure medium which is delivered to the lower part of the tube acting upon the sealing holder such that the same is pressed against a sealing surface located above it and is pressed counter to the effect of the downwardly directed forces on the sealing and the sealing holder.

By designing the sealing holder in accordance with the present invention so that it is radially movable and balances the downwardly and upwardly directed forces on the sealing holder, a sealing function is obtained which is maintained even in the presence of large lateral movements of the packing material tube or the filling pipe and under varying gas pressures in the lower part of the tube. The contact pressure between the sealing and the inside of the packing material tube can be maintained substantially constant around the whole periphery of the packing material tube, and irrespectively of lateral movements of the material tube which achievement previously had not been possible.

It is a further object in this context to provide an arrangement which is of simple construction, has a long service life and can be manufactured at low costs.

It is a further object of the arrangement in accordance with the invention to provide a sealing unit which has a minimum of movable parts, which lacks springs, maneuvering elements or the like and which consequently is easy to clean and to sterilize and thus is particularly suitable for use in aspectic packing machines.

It is a further object of the arrangement in accordance with the invention to provide a sealing unit wherein the actual sealing can be replaced in a simple and inexpensive manner should this prove to be necessary.

These and other objects are achieved in accordance with the present invention which provides a sealing unit comprising a stationary sealing guide situated in the tube, which sealing guide supports a movable sealing holder with a peripherally located annular sealing member which rests against the inside of the material tube.

By providing the sealing unit in accordance with the invention with a sealing holder movable in lateral direction which in turn supports the peripherally located sealing member, the sealing member and the movable function of the unit have been separated from one another which means that each of the said parts for itself can be optimized for its particular task so as to give an improved overall result. Since the sealing holder participates in the necessary lateral movement, the flexibility of the seal, for example, needs no longer to be as great, thus making it possible to select sealing material with improved characteristics, for example, from a point of view of wear.

BRIEF DESCRIPTION OF THE DRAWING

A preferred embodiment of the method as well as of the arrangement in accordance with the invention will now be described in more detail with special reference to the enclosed schematic drawings which only show the parts necessary for an understanding of the invention.

DETAILED DESCRIPTION OF THE PREFERRED EMBODIMENT

Figure 1:
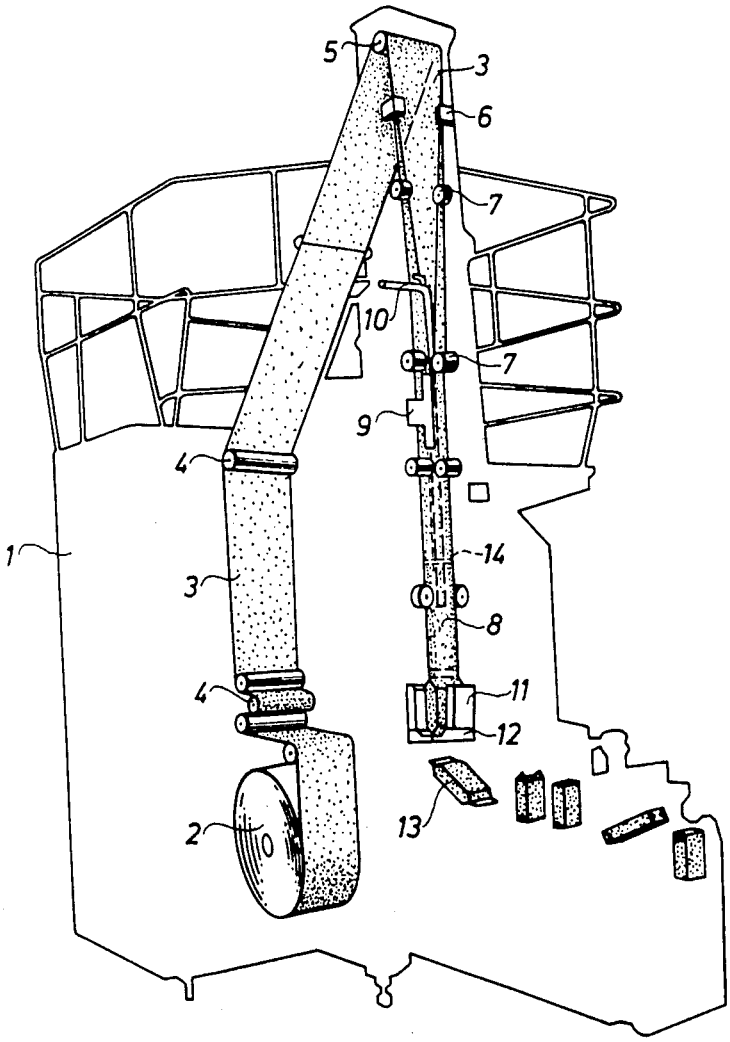
FIG. 1 is a perspective view of a packing machine for the conversion of a weblike packing material to individual packing containers wherein use is made of the method and arrangement in accordance with the invention.

The packing machine shown in FIG. 1 is of the previously known type which converts weblike packing material to individual packing containers. The packing material is a laminate which usually comprises a central carrier layer of paper which is covered on either side with thin, liquid-tight layers of thermoplastic material, e.g. polyethylene. When packing containers for sterile contents are to be manufactured, an aseptic packing laminate is used which further comprises layers of gas barrier material such as aluminium foil. Prior to the conversion to individual packing containers the packing laminate is passed through bactericidal arrangements, e.g. a bath containing hydrogen peroxide or the like, whereupon the conversion and filling can take place under aseptic conditions. This technique as well as the packing machines for its realization are well known to those versed in the art and no detailed description is required therefore in this context.

It is also evident from FIG. 1 how the packing material is delivered to the packing machine 1 in the form of a roll 2 which is supported so that it can rotate in the magazine of the packing machine. From the magazine the packing material web 3 moves via a number of guide rollers 4 up to the upper part of the machine where it passes over a deflection roller 5, thereafter to continue substantially vertically downwards through the packing machine. With the help of various folding and forming elements 6,7 arranged along the path of movement of the material web 3, the packing material web 3 during its downward movement through the machine is converted successively to tubular form in that its two longitudinal edges are guided towards each other and are sealed together so that a material tube 8 with a longitudinal, liquid-tight seal is produced. The sealing together of the two longitudinal edges takes place with the help of a supply of heat by a hot air nozzle 9, which heat causes the parts of the thermoplastic layers situated at the edges are made to melt. Thereafter, the two longitudinal edges are pressed together with simultaneous cooling. As a result, the thermoplastic layers are joined to one another so that the required, wholly liquid-tight, joint is obtained.

The contents are then conducted to the lower end of the formed material tube 8 via a filling pipe 10 which extends in through the upper open end of the packing material tube 8. The filling pipe then runs substantially concentrically downwardly through the packing material tube and opens a short distance above this lower end. At some distance below the opening of the filling pipe 10, forming and sealing jaws 11,12 are arranged on either side of the packing material tube 8 which are adapted so as to process the packing material tube 8 in pairs between themselves. For the sake of clarity only one set of forming and sealing jaws is shown in the figure, but in practice usually a further number of jaws is present which alternatingly process the packing material tube.

The sealing jaws 12 are moved continuously to and fro in the direction towards and away from each other respectively so as to compress and seal the packing material tube 8 at uniform intervals along transverse sealing zones. At the same time the sealing jaws 12 are moved to and fro in vertical direction so that when they are in the upper end position they are moved towards one another and compress and retain the packing material tube. In the subsequent movement through the packing machine the walls of the packing material tube are compressed and welded to each other, the material tube being advanced at the same time over a distance which corresponds to the length of one packing container blank. During the displacement downward the two forming jaws 11 are swung towards each other so that the part of the packing material tube 8 which is located directly above the sealing jaws 12 is partly compressed and formed to the desired shape, in this case substantially cushion shape with a rectangular cross-section. When the sealing jaws 12 have reached their lower position the forming jaws 11 are swung out again at the same time as the material tube is severed by a transverse cut through the zone compressed by the sealing jaws. As a result a packing container 13 formed previously will be detached from the packing material tube. After the sealing jaws 12 have been moved away from each other the packing container 13 is passed on with the help of a conveyor (not shown) for continued processing and final forming so that a packing container of the required shape (in this case parallelepipedic) is produced.

As mentioned previously, the desired contents are delivered to the lower end of the packing material tube 8 via the filling pipe 10. In continuous operation of the packing machine partly filled packing containers are produced either by delivering the contents continuously at such a rate that each individual packing container formed has been filled with the desired quantity when the delivery is interrupted by flattening and sealing of the tube or else by delivering the desired quantity of contents in portions as soon as a transverse sealing has been made in the tube.

Figure 2:
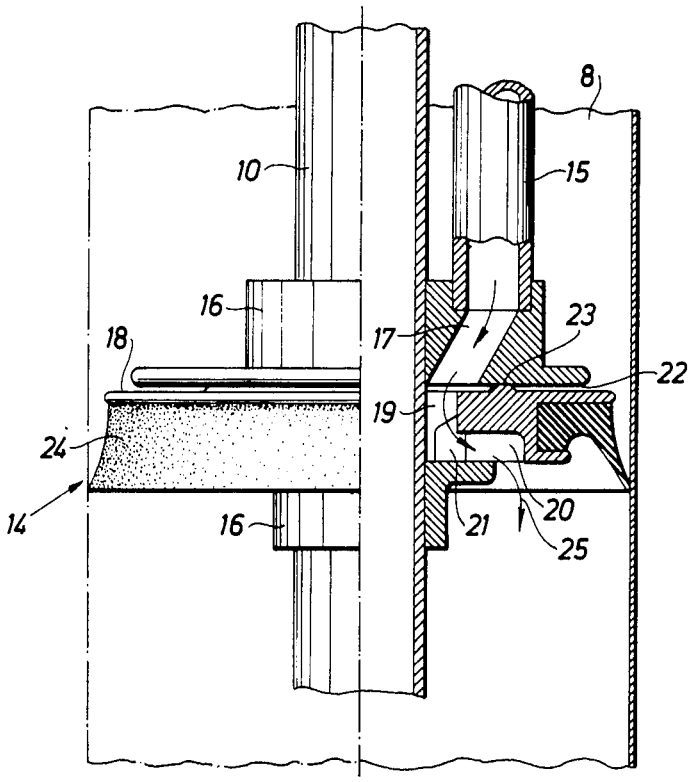
FIG. 2 is a detailed side view partly in section of a sealing unit in accordance with the invention as arranged on the packing machine of FIG. 1.

The production of a not completely filled packing container means of course that an air space is created at the upper end of the packing container. On conversion of the lower end of the packing material tube to individual packing containers the air or gas in the packing material tube must be enclosed in a suitable manner, since otherwise the counterpressure which is required for a satisfactory forming process is not obtained. In order to produce the necessary counterpressure in spite of the presence of the air space, the packing machine therefore comprises a sealing unit 14 arranged around the filling pipe 10 placed at some distance from the opening of the filling pipe which seals off the lower end of the material tube from the surrounding atmosphere. The sealing unit 14 is supported by the filling pipe 10 and rests forming a seal against the same as well as against the inside of the packing material tube. Beside the filling pipe 10 another continuous pipe 15 extends through the sealing unit for the delivery of gas, e.g. inert gas or air, to the lower closed end of the packing material tube. Referring to FIG. 2, the gas delivery pipe 15 communicates with the space below the sealing unit and thus permits delivery of a suitable pressure medium to the lower part of the packing material tube 8 separated by the sealing unit which consequently can be maintained under a suitable pressure during the forming and flattening of the lower end of the tube. The delivery pipe 15 for pressure medium, just as the filling pipe 10, enters through the upper open part of the packing material tube and thereafter extends downwardly parallel with the filling pipe 10 through the packing material tube and the sealing unit 14. If required, further pipes for the delivery of, for example, different types of contents etc. may likewise extend down through the material tube and pass the sealing unit 14. This is not shown, however, on the drawing.

As is evident from FIG. 2, the sealing unit comprises a sealing guide 16 divided into two parts, the upper and lower parts being connected to the filling pipe 10 in a suitable manner, e.g. with the help of a screw joint not shown in the drawing. The upper part of the guide 16 serves as a fastening for the lower end of the gas delivery pipe 15 and comprises, moreover, a duct 17 which connects the lower end of the gas delivery pipe 15 to the space in the packing material tube present below the upper guide part 16.

Between the upper and lower part of the sealing guide 16 there is a space in the form of a circular groove wherein a sealing holder 18 is arranged so that it can move. The space between the two parts of the sealing guide 16 is a little larger than the corresponding dimension of the sealing holder 18 which means that the sealing holder 18 is movable in radial as well as in axial direction. However, the movement in axial direction is restricted to a few tenths of a millimeter. The sealing holder 18 has a center hole 19 whose diameter is appreciably greater than the outside diameter of the filling pipe 10. As a result a passage 20 is formed between the outside of the filling pipe 10 and the sealing holder 18 for the pressure medium flowing via the gas delivery pipe 15 and the duct 17. Projections 21 are arranged at uniform intervals around the center hole 19 in order to limit in an appropriate manner the radial movements of the sealing holder 18 in relation to the filling pipe 10.

The upper part of the sealing guide 16 is provided on its underside with a plane sealing surface 22 which is located at a little distance above the upper, likewise plane, surface of the sealing holder 18. On the upper surface of the sealing holder 18 a projecting annular sealing element 23 is provided which may be made e.g. of tetrafluoroethylene and which has a diameter which exceeds the diameter of the centre hole 19 and makes it possible to seal off the passage between the duct 17 in the sealing guide 16 and the centre hole 19 in the sealing holder 18 so that the pressure medium cannot flow out into the upper, open part of the material tube via the space between the sealing holder and the upper part of the guide 16.

On the periphery of the sealing holder 18 there is an annular sealing member 24 of flexible material, e.g. silicone rubber which is provided with a lip facing downwardly. The lip which is pressed against the inner surface of the packing material tube, partly because of the flexibility of the sealing material and partly because of the pressure prevailing at the lower end of the material tube.

The construction of the sealing unit in accordance with the invention shown in FIG. 2 is simplified for the sake of clarity and elements, known in themselves, for the mounting, dismantling and adjustment of the unit have not been illustrated. It is understood, however, that such elements are present so as to make it possible, for example, to remove the lower sealing guide 16 from the filling pipe 10 for a replacement of the sealing holder and the sealing and an adjustment of the space between the two parts of the sealing guide 16.

In the manufacture of partly filled packing containers 13 by means of the packing machine and sealing unit in accordance with the invention, as mentioned previously, a roll 2 with packing material 3 is placed into the packing machine. The packing laminate 3 moves upwards through the machine, and when it has passed the deflection roller 5 located at the upper end of the machine it moves substantially vertically downwardly while being successively converted to tubular form through sealing together of the longitudinal edges of the web. After the sealing together the liquid-tight packing material, tube 8 passes the sealing unit 14 so that the same delimits a closed space at the lower end of the tube. A gaseous pressure medium is now conducted via the gas delivery pipe 15 to the closed space in the packing material tube 8 so that the same is placed under pressure. The pressure medium, which, for example, may be sterile air or inert gas, is delivered at a pressure of max. 0.3 bar, preferably 0.15 bar, which is suitable as a counterpressure for the sealing together and forming of the lower end of the packing material tube.

The gas delivery is taking place, as indicated by means of an arrow 25 in FIG. 2, via the gas delivery pipe 15, the duct 17 in the upper sealing guide 16, inside the sealing element 23, via the centre hole 19 and out through the passage 20 in the lower surface of the sealing holder 18. In so doing the gaseous pressure medium will act upon the sealing holder with its sealing so that the sealing element 23 is pressed against the sealing surface 22 in spite of the weight of the sealing holder and the downwardly directed force which acts upon the sealing holder 18 because of the sealing 24 resting against the inside of the packing material tube which, of course, moves continuously downwardly. The magnitude of the contact pressure of the sealing element 23 against the sealing surface 22 is determined by the difference in size between the surface of the lower side of the sealing holder which is subjected to an upwards directed pressure force from the pressure medium and the surface on the upper side of the sealing holder 18 which is subjected to a downwards directed pressure force. In this connection the diameter of the sealing element 23 is chosen so that the difference between the size of the surface gives a desired upwards directed force which is greater than the downwards directed force caused by the movement of the tube and the weight of the sealing holder 18. As a typical value for the ratio between the area of the surfaces acted upon by the pressure on the lower side of the sealing holder 18 (including the sealing 24) and its upper side respectively may be mentioned 4:1, and in absolute figures it can be stated that with a tube diameter of for example approx. 100 mm (in the manufacture of packing containers for approx. 1 liter contents) the area of the lower surface is 58 $cm^2$ and the area of the upper surface is 13 $cm^2$. The contact pressure of the sealing element 23 against the sealing surface will then amount to approx. 0.5 bar which has been found to provide satisfactory safety against leakage. Owing to this construction in accordance with the invention the contact force of the sealing element 23 against the sealing surface 22 can be determined accurately and chosen so that the desired degree of tightness is obtained whilst at the same time the sealing holder 18 remains sufficiently movable in radial direction so as to provide a good seal in spite of relative movements in radial direction between the material tube 8 and the filling pipe 10 supporting the sealing unit 14. By choosing the minimum possible contact pressure the sealing holder 18 will be readily movable in lateral direction which means that the ability of the sealing 24 to follow will be great so that the sealing effect is optimized at the same time as the wear owing to contact against the movable packing material wall is reduced. Because the need for a flexible material in the sealing 24 is consequently diminished, it becomes possible in the choice of material to pay more attention to wear resistance of the sealing which further improves the function.

The sealing unit in accordance with the invention has proved in practice to function very well and the sealing unit has made it possible for the first time to manufacture partly filled packing containers from tubular material in a rational and economical manner.

It is to be understood that the present invention may be embodied in other specific forms without departing from the spirit or essential characteristics of the present invention. The preferred embodiment is therefore to be considered illustrative and not restrictive. The scope of the invention is indicated by the appended claims rather than by the foregoing descriptions and all changes and variations which come within the meaning and range of the claims are therefore intended to be embraced therein.

What is claimed is:

1. In a method of the type converting a packing material web into packing containers including the steps of converting the material web to a tube, moving the tube in a downward direction along a path, repeatedly transversely flattening and bonding together a lower end of the tube and supplying contents to a lower, interior zone of said tube through a fixed filling pipe, the improvement comprising the steps of sealing off a lower portion of the tube from an upper open portion of the tube by contacting an inside surface of the tube with a sealing member located on the periphery of a radially-moveable sealing holder supported by said filling pipe, delivering a gaseous pressure medium to the lower part of the tube, positioning in fixed relationship with said filling pipe a radially extending sealing surface above the sealing holder and pressing the sealing holder with the gaseous pressure medium into engagement with the sealing surface sufficiently to counter downwardly directed forces on the sealing member and the sealing holder, whereby upon displacement of said tube in a radial direction relative to said filling pipe, said sealing holder may move relative to said sealing surface in said radial direction with said tube.

2. The method in accordance with claim 1, wherein the pressure medium is delivered to the lower part of the tube via an opening in the sealing holder, said method further comprising the step of maintaining the combined downwardly directed forces upon the sealing holder from the pressure medium and from the packing material tube smaller than an upwardly directed force acting upon the sealing holder from the pressure medium present in the lower part of the packing material tube.

3. The method in accordance with claim 1, wherein the pressure medium is at a pressure in the range of 0.3 bar and approximtely 0.15 bar.

4. In a packing machine of the type which converts a tube of packing material moving downwardly along a path into individual packing containers, the improvement comprising a sealing holder, a sealing guide having a sealing surface, means for supporting said sealing guide within the tube at a radially and longitudinally fixed location along said path with said sealing surface extending radially relative to said path, said sealing holder retained by the sealing guide in position beneath said sealing surface and including means for allowing radial movement of said sealing holder with respect to said sealing guide and an annular sealing member peripherally located on the sealing holder, the annular sealing member contacting an inside surface of the tube, whereby a lower portion of the tube is sealed from an upper portion of the tube, means for delivering a gaseous pressure medium to said lower portion of the tube, said sealing holder adapted to be urged toward said sealing surface by presence of pressure medium in said lower portion, whereby upon displacement of said tube in a radial direction with respect to said path, said sealing holder may move in said radial direction with said tube.

5. The arrangement in accordance with claim 4, wherein the sealing guide comprises two axially spaced parts between which the sealing holder is arranged with clearance so that the sealing holder can move relative to said sealing guide.

6. The arrangement in accordance with claim 5, wherein the axial space between the two parts of the sealing guide is larger than a corresponding axial dimension of the sealing holder.

7. The arrangement in accordance with claim 4, further comprising an annular sealing element between the sealing holder and the sealing guide, the sealing guide and the sealing holder having throughgoing passages for conveying the pressure medium, these passages being located radially inside of the annular sealing element.

8. The arrangement in accordance with claim 7, wherein the sealing holder is adapted to urge the sealing element against an adjacent sealing surface of the sealing guide in the presence of the pressure medium.

9. The arrangement in accordance with claim 8 wherein the sealing holder includes a first surface situated radially inside of the sealing element which is acted upon by the pressure medium so as to urge said sealing holder in a first direction away from said sealing surface and a second surface which is acted upon the pressure medium so as to urge said sealing holder in an opposite direction, said second surface being larger than said first surface.

10. The arrangement in accordance with claim 9, wherein the ratio between the second surface and the first surface is selected such that a contact pressure of the sealing element against the sealing surface is approximately 0.5 bar.

11. The arrangement in accordance with claim 4, wherein said means for supporting said sealing guide is a conduit for delivering fluid to a lower portion of said tube and said sealing holder is arranged with radial clearance with respect to said tube so that the sealing holder can move radially with respect to said tube.

12. In a packing machine of the type in which a tube of packing advances continuously downward while liquid contents are supplied to the interior of the tube to a lower zone in said tube through a fixed filling pipe and gas is supplied to said lower zone through a seal between said filling pipe and said tube, the improvement comprising a seal ring, collar means on said filling pipe, said seal ring being mounted in said collar means, said collar means and said seal ring including means for allowing radial movement of said seal ring relative to said filling pipe, and a flexible sealing element on said seal ring for engaging the interior of said tube and maintaining a seal between said tube and said filling pipe.

13. The packing machine in accordance with claim 12, wherein said collar means includes upper and lower bodies affixed to said filling pipe at axially spaced locations along said filling pipe, said seal ring mounted with clearance upon said filling pipe between said upper and lower bodies.

14. The packing machine in accordance with claim 13, wherein an annular seal is provided between a said upper body and said seal ring, said annular seal being radially spaced from said filling pipe, said packing machine further comprising a passage through said upper body and said seal ring for supplying gas to said lower zone, said passage passing between said filling pipe and said annular seal.

* * * * *